US006672762B1

(12) United States Patent
Faircloth et al.

(10) Patent No.: US 6,672,762 B1
(45) Date of Patent: Jan. 6, 2004

(54) PACKAGE WITH ARCUATE TOP HAVING INTEGRAL LATCH AND HANGER

(75) Inventors: Michael Faircloth, Winston-Salem, NC (US); J. Reid London, Clemmons, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 09/500,272

(22) Filed: Feb. 8, 2000

(51) Int. Cl.[7] ..... B65D 33/10

(52) U.S. Cl. ..... 383/9; 206/278; 206/806; 383/86

(58) Field of Search ..... 383/86, 86.2, 9; 229/116.1, 149, 148, 117.18; 206/278, 806, 822, 299; 150/118, 107; D9/414, 415, 420

(56) References Cited

U.S. PATENT DOCUMENTS

| | | | | | |
|---|---|---|---|---|---|
| 1,291,024 | A | * | 1/1919 | Kleebauer | |
| 1,368,579 | A | * | 2/1921 | Schochet | 150/118 |
| 1,482,783 | A | * | 2/1924 | Boucher | 383/84 |
| 1,683,100 | A | * | 9/1928 | Rozowsky | |
| 1,760,681 | A | * | 5/1930 | Barol | 150/107 |
| 1,855,358 | A | * | 4/1932 | Maksik | 150/107 |
| 1,947,718 | A | * | 2/1934 | Labadie et al. | 190/115 |
| 1,975,804 | A | * | 2/1934 | Seifer | 206/299 X |
| 2,010,267 | A | * | 8/1935 | Klotz | 190/106 |
| 2,262,313 | A | * | 11/1941 | Clappier | 224/655 |
| 2,428,159 | A | * | 9/1947 | Hines | 190/106 |
| D154,119 | S | * | 6/1949 | Gumbrill | 150/118 X |
| 2,515,316 | A | * | 7/1950 | Schjelderup | 383/16 X |
| 2,669,273 | A | * | 2/1954 | Keirsey | 190/115 |
| 2,704,180 | A | * | 3/1955 | Goebel et al. | |
| 2,912,079 | A | * | 11/1959 | Heitler | 206/278 X |
| 3,025,998 | A | * | 3/1962 | Peterson | 220/836 X |
| 3,029,855 | A | * | 4/1962 | Telford | 220/836 X |
| 3,125,279 | A | * | 3/1964 | Watts et al. | 229/149 |
| 3,452,405 | A | * | 7/1969 | Paynor | 150/107 X |
| 3,557,853 | A | * | 1/1971 | Jones | |
| 3,768,531 | A | * | 10/1973 | Kryznoksi | |
| 3,811,613 | A | * | 5/1974 | Harrison | 383/84 X |
| 3,814,235 | A | * | 6/1974 | Glaze, Jr. | 206/278 |
| 3,871,523 | A | * | 3/1975 | Basett | 206/278 X |
| 3,924,800 | A | * | 12/1975 | Desmond et al. | 229/149 |
| 3,977,596 | A | * | 8/1976 | Gamble | |
| 4,099,665 | A | * | 7/1978 | Bergstein | |
| 4,102,487 | A | * | 7/1978 | Soto | |
| 4,184,596 | A | * | 1/1980 | Avery | |
| 4,230,259 | A | * | 10/1980 | Herzog | 229/149 |
| 4,243,171 | A | * | 1/1981 | Prin | |
| 4,252,220 | A | * | 2/1981 | London et al. | 206/287 X |
| RE31,075 | E | * | 11/1982 | London et al. | 206/287 X |
| 4,484,683 | A | * | 11/1984 | Werner, Jr. | 229/149 |
| 4,715,728 | A | * | 12/1987 | Sfikas | |
| 4,742,914 | A | * | 5/1988 | Klein | 206/806 X |
| 5,064,113 | A | * | 11/1991 | Hauber et al. | |
| 5,071,003 | A | * | 12/1991 | Freelander | 383/9 X |
| 5,083,700 | A | * | 1/1992 | Mello et al. | 206/806 X |

(List continued on next page.)

FOREIGN PATENT DOCUMENTS

| | | | | |
|---|---|---|---|---|
| DE | 3002106 | * | 7/1981 | 383/16 |

OTHER PUBLICATIONS

"PrimePac launch expected this year", Packaging Week, vol. 10, No. 35, Feb. 16, 1995, p. 8.*

*Primary Examiner*—Robin A. Hylton
(74) *Attorney, Agent, or Firm*—Kilpatrick Stockton LLP

(57) ABSTRACT

A flexible package with a body portion that includes a front, a back, a bottom and two sides. A top portion extends from the front upwardly and rearwardly, ultimately engaging the back in a secured relationship with a latch. A hanger is formed in the end of the top to allow the package to be suspended or hung from a hook or peg.

7 Claims, 5 Drawing Sheets

U.S. PATENT DOCUMENTS

D335,257 S * 5/1993 Hauber et al.
5,230,463 A * 7/1993 Brauner
5,287,960 A * 2/1994 Kalb et al.
5,390,786 A * 2/1995 Challoner et al. ..... 206/278
5,405,629 A * 4/1995 Marnocha et al. ..... 206/806 X
5,441,198 A * 8/1995 McQueeny ..... 206/806 X
5,526,836 A * 6/1996 Sigsworth ..... 150/107 X
5,730,296 A * 3/1998 Limmer ..... 206/806 X
5,819,939 A * 10/1998 Boyer ..... 206/806 X
5,857,586 A * 1/1999 Scherr ..... 383/9 X
5,873,456 A * 2/1999 Hull et al.
5,927,581 A * 7/1999 Reddy et al. ..... 224/655 X
5,957,354 A * 9/1999 Mentken ..... 224/627 X
5,975,415 A * 11/1999 Zehnal ..... 206/806 X
6,032,793 A * 3/2000 Oakley ..... 206/299 X
6,145,659 A * 11/2000 Faircloth et al.
6,149,003 A * 11/2000 Day ..... 383/86 X

* cited by examiner

PACKAGE WITH ARCUATE TOP HAVING INTEGRAL LATCH AND HANGER

BACKGROUND OF THE INVENTION

1. Field of the Invention

The present invention relates generally to packages and more particularly to a flexible package having an upwardly and rearwardly extending top.

2. Description of the Prior Art

Innovative packaging has been used for a considerable period of time to display and market various items of apparel, particularly smaller items of apparel such as hosiery, socks and lingerie as well as jewelry. For example, a major hosiery brand was developed in the late 1960s utilizing a plastic egg shaped package held on a cylindrical pedestal. That packaging was innovative and attractive, however, it could be destroyed by an enthusiastic shopper when it was opened by the shopper to exam the garment itself. Once opened, the package could not be resealed, and it was usually necessary to replace it and the garment in total.

The hosiery program utilizing the plastic egg-like package ultimately converted its packaging to flexible cardboard because of the expense associated with the plastic egg and because of the damage it suffered in the marketplace from opened and unpurchased packaging. The replacement package was cardboard and shaped somewhat like the egg package; however, it was considerably cheaper to produce and discouraged, to a somewhat greater degree, opening by shoppers because it was glued in a sealed condition around the garment. Even in this condition; however, many packages were still opened by shoppers to exam the garment in greater detail and to be assured that the contents of the package were in fact what was represented on the surface of the package.

At the present time, there is no package in existence that can permit an examination by the potential purchaser of the contents of the package without destroying the package and perhaps damaging the product, and it is to this critical need that the present invention is directed.

OBJECTIVES AND SUMMARY OF THE INVENTION

It is a principal objective of the present invention to provide a flexible package for smaller apparel items and accessories that encompasses all of the benefits of prior art devices and more and contains none of the deficiencies of such devices.

A further objective of the present invention is to provide a package of the type described that is simple in construction and operation and less expensive than currently used similar devices.

Yet another objective of the present invention is to provide a package of the type described which can be opened and reclosed by the shopper without doing damage to either the package or its contents.

Still another objective of the present invention is to provide a package that will reduce the maintenance time required to service displays carrying such packaging and to reduce the damage associated with opening the packaging and examining the contents that has been experienced in the past.

From the foregoing objectives, it can be seen that the present invention is a flexible package having a body portion with a front, back, bottom and two sides and a top portion extending from the front upwardly and curving rearwardly and having a terminal end forming a latch to secure the top portion to the back of the body portion as well as providing a hanger for displaying the package on a peg board or hook. The sides are inwardly tapered to cooperatively join the back near the location where the latch is secured to the back of the body portion, and the leading edge of the sides mates neatly with the arcuately extending top, but is not bonded or firmly secured thereto. The latch on the terminal end of the top portion and the hanger adjacent thereto are diecut tabs with the hanger having a hole to cooperatively receive a peg or hook for supporting the package.

Thus, there has been outlined the more important features of the invention in order that the detailed description that follows may be better understood and in order that the present contribution to the art may be better appreciated. There are, of course, additional features of the invention that will be described hereinafter which will form the subject matter of the claims appended hereto. It is to be understood that the invention is not limited in its arrangement of the components set forth in the following description or illustrated in the drawings. The invention is capable of other embodiments and of being practiced and carried out in various ways.

It is also to be understood that the phraseology and terminology used herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the invention. It is also to be understood that the abstract is neither intended to define the invention of the application, which is measured by its claims, nor to limit its scope in any way.

Thus, the numerated objectives and others identified herein, along with the various features of novelty which characterize the invention, are pointed out with particularity in the claims annexed to and forming a part of this disclosure. For a better understanding of the invention, its operating advantages, and the specific objects obtained by its use, reference should be made to the accompanying drawings and descriptive matter in which like characters of reference designate like parts throughout the several views.

DETAILED DESCRIPTION OF THE PREFERRED EMBODIMENT

Figure 1:
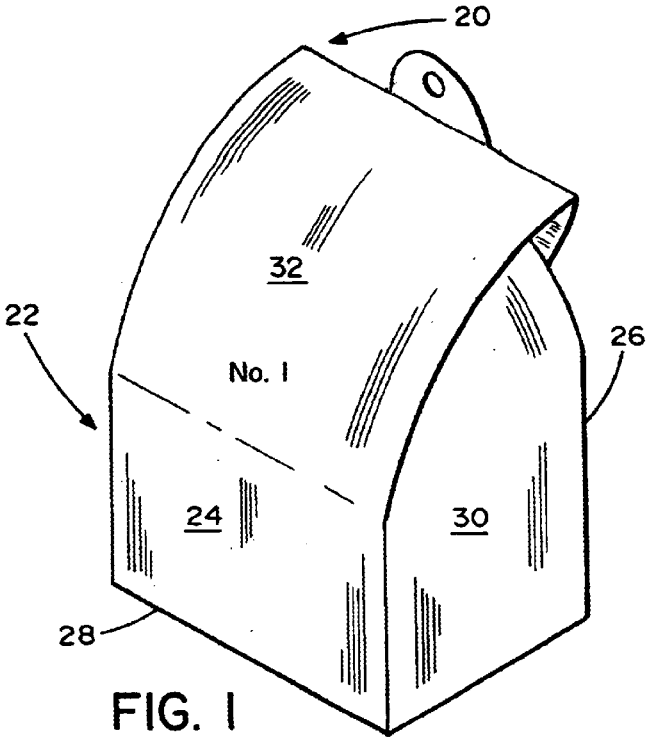
FIG. 1 is a perspective view of a first embodiment of the present invention joined at the front and one side.
Figure 2:
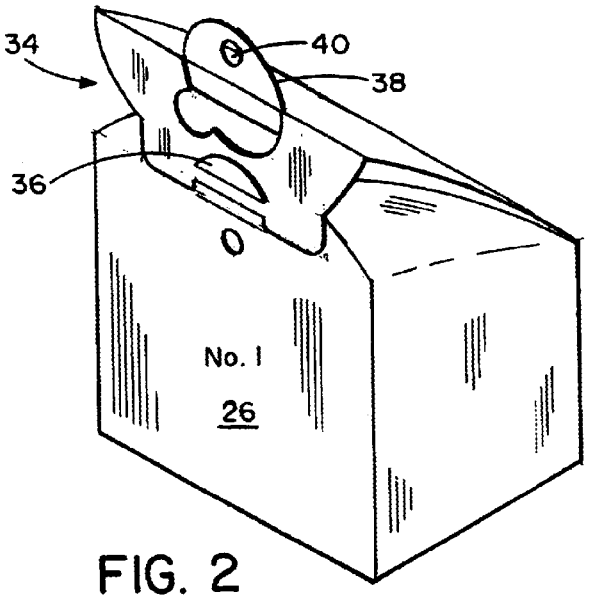
FIG. 2 is a perspective view of the embodiment of the invention shown in FIG. 1 joined primarily at the rear and the other side.

Referring now to the drawings and particularly to FIG. 1, the flexible package of the present invention is shown generally as 20 and includes a body portion 22 having a front 24, a back 26, a bottom 28 and two sides 30. A top portion 32 extends from front 24 upwardly and arcuately rearwardly and has a terminal end 34 (FIG. 8) forming a latch 36 produced by diecutting. Terminal end 34 also contains a hanger 38 with an aperture 40 both formed by diecutting terminal end 34. Latch 36 engages slot 42 to hold top 32 in a releasably secured position against back 26. The positioning of the latch 36 and hanger 38 is shown in a secured relationship in FIGS. 2 and 6.

Figure 6:
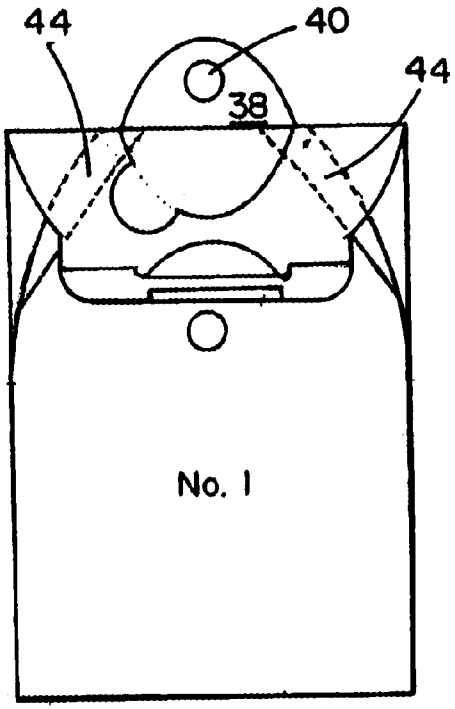
FIG. 6 is a rear elevational view of the embodiment of the invention shown in FIGS. 1 and 2.
Figure 5:
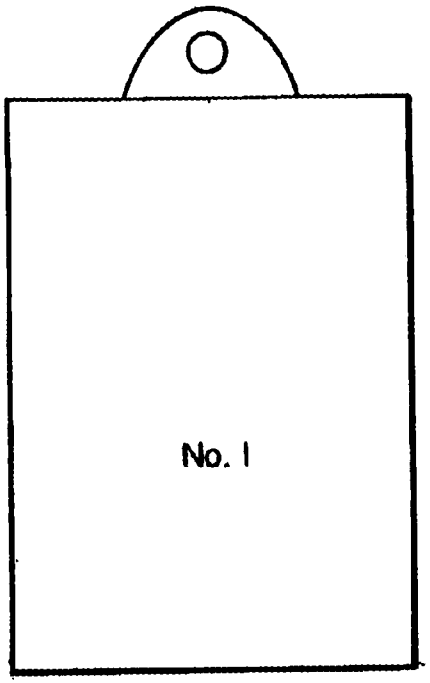
FIG. 5 is a front elevational view of the embodiment of the invention shown in FIGS. 1 and 2.

The sides are arcuately and upwardly tapered from front 24 to back 26 with the back joining edges 44 folded to join the back in a flat surface-to-surface relationship and secured in that position by glue or another appropriate adhesive. This construction is best shown in FIGS. 6 and 7.

Figure 7:
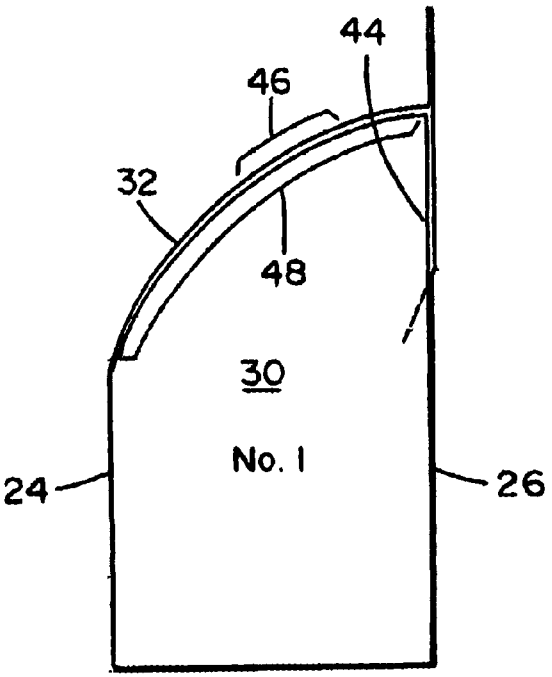
FIG. 7 is a side elevational view of the embodiment of the invention shown in FIGS. 1 and 2.

Sides 30 join with front 24 and meet but are not secured to top 32 as shown in FIG. 7. The curve 46 of top 32 and the upper edge 48 of sides 30 are designed to cooperatively meet and form a closed but unsecured relationship.

Figure 8:
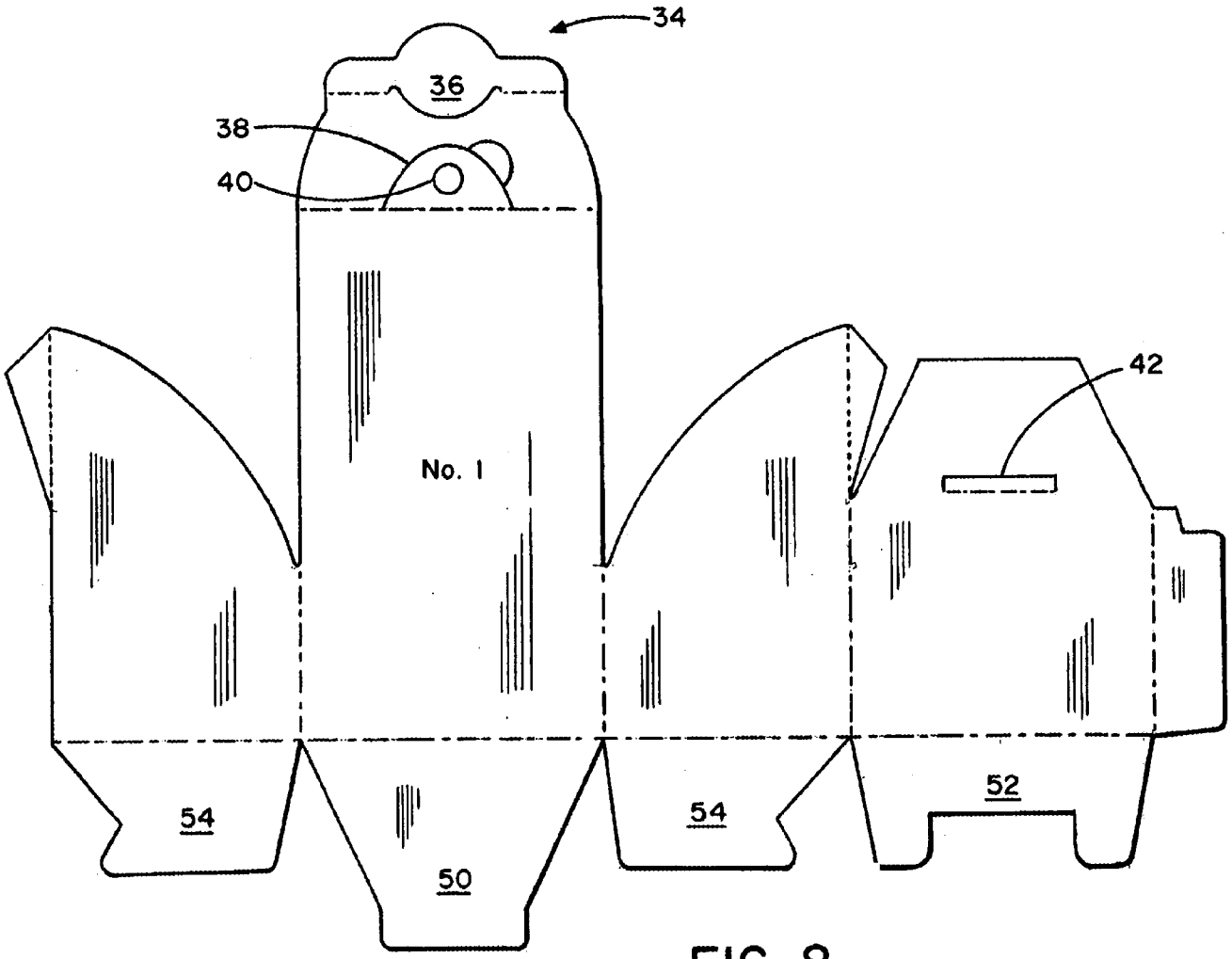
FIG. 8 is an unfolded blank of the embodiment of the invention shown in FIGS. 1 and 2.

As seen in FIG. 8, formed and downwardly extending lower tabs 50, 52, 54 form the front, back and sides. Tabs 50, 52, 54 fold and cooperatively engage with each other to extend from the bottom 28 of package 20.

Figure 3:
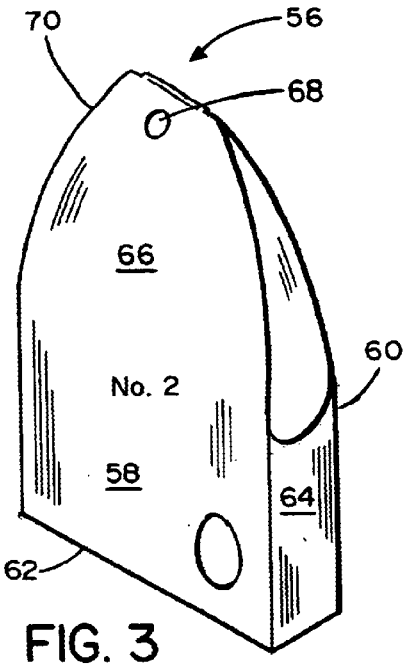
FIG. 3 is a perspective view of a second embodiment of the present invention joined primarily at the front and one side.
Figure 4:
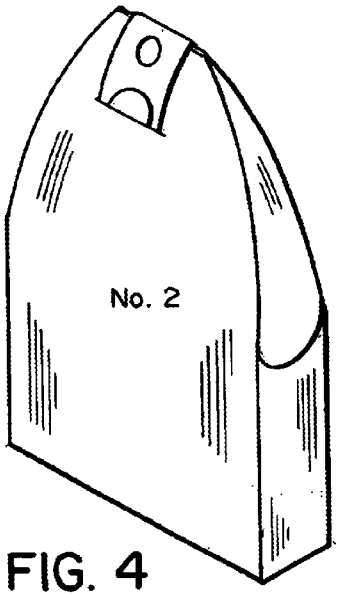
FIG. 4 is a perspective view of the embodiment of the invention shown in FIG. 3 emphasizing the back and the other side.
Figure 11:
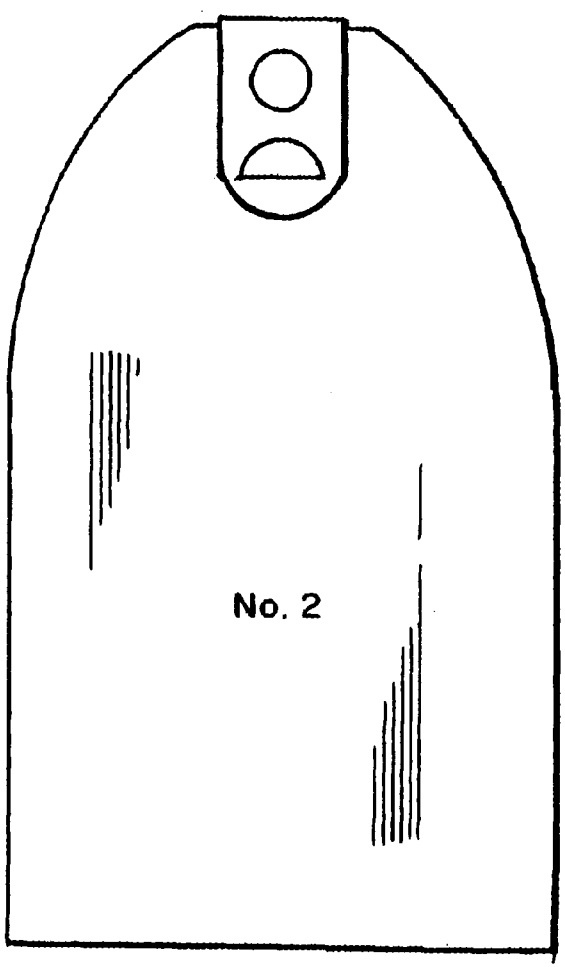
FIG. 11 is a rear elevational view of the embodiment of the invention shown in FIGS. 3 and 4.
Figure 10:
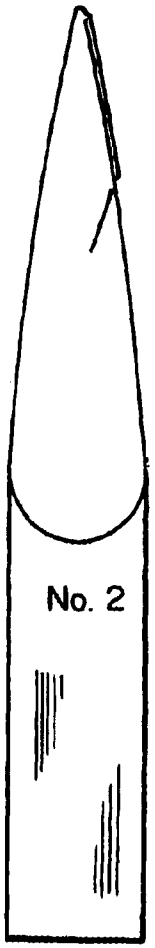
FIG. 10 is a side elevational view of the embodiment of the invention shown in FIGS. 3 and 4.
Figure 9:
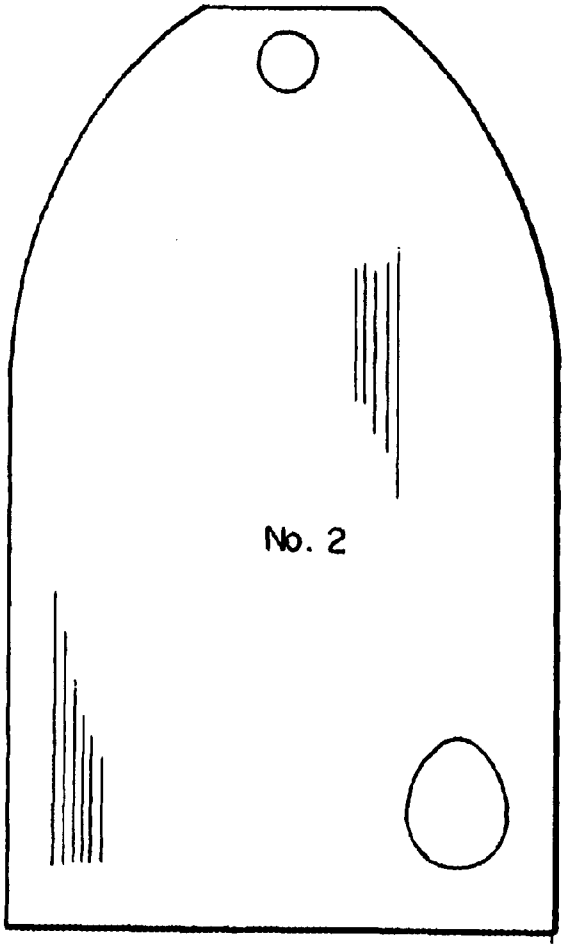
FIG. 9 is a front elevational view of the embodiment of the invention shown in FIGS. 3 and 4.
Figure 12:
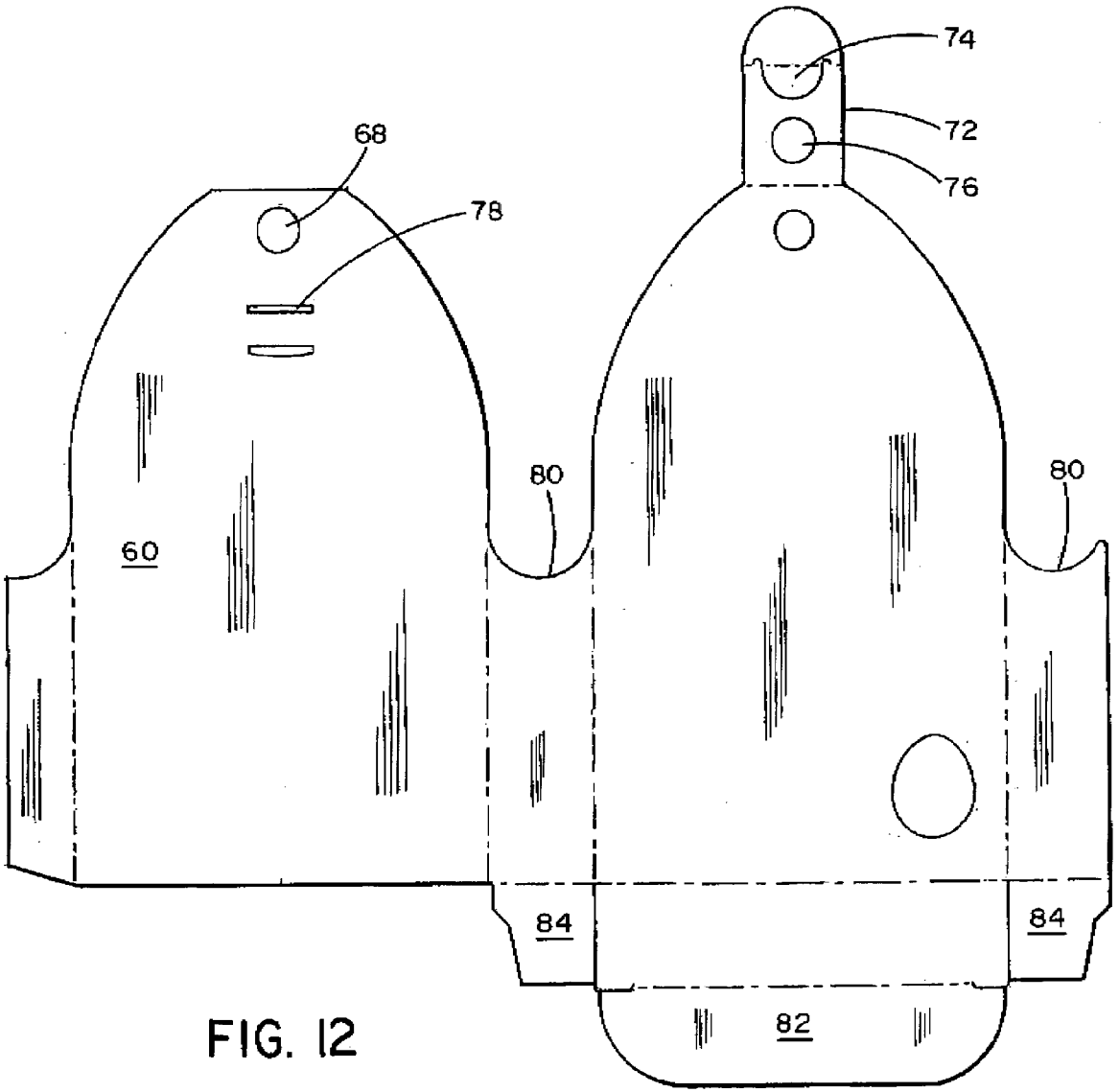
FIG. 12 is an unfolded blank of the embodiment of the invention shown in FIGS. 3 and 4.

The embodiment shown in FIGS. 3 and 4 and designated generally as 56 is somewhat thinner in construction and greater in height than package 20. Package 56 has a front 58, a back 60, a bottom 62 and sides 64. Top portion 66 has an aperture 68 in its terminal end 70 and a tab 72 extending therefrom (FIG. 12). Tab 72 has a diecut latch 74 and aperture 76 so that when folded along back 60 and inserting tab 74 in slit 78, aperture 68 aligns with aperture 76 to cooperatively receive a peg or hook for display. Sides 64 extend partially up the height of package 56 and join front 58 and back 60 in a symmetrical downwardly extending curve 80. With the sides formed in this design, the package takes on a front, rear and side symmetry best seen in FIGS. 9, 10 and 11 in a side-by-side relationship.

Bottom 62 is formed in a conventional manner by two side tabs 84 and a middle tab 82 which extend upwardly against back 60 when closed.

Both embodiments of the present invention can be made from a single piece of configured material as is illustrated in FIGS. 8 and 12. The ability to fashion packages from a single piece of material results in a significant savings in labor and materials. While multiple pieces may be used to form similar packaging, the single piece construction is preferred.

Thus two embodiments of the flexible package have been illustrated and described in operable form. It is to be realized that optimum dimensional relationships for the parts of the invention to include variations in size, materials, shape, form, function and manner of operation, and assembly in use are deemed readily apparent and obvious to one skilled in the art. All equipment relationships to those illustrated in the drawings and described in the specification are intended to be encompassed herein. The foregoing is considered as illustrative only of the principles of the invention. Numerous modifications and changes will readily occur to those skilled in the art, and it is not desired to limit the invention to the exact construction and operation shown and described. All suitable modifications and equivalence that fall within the scope of the appended claims are deemed within the present inventive concept.

What is claimed is:

1. A flexible package comprising:

a body portion having a front, a back, a bottom and two sides; and a top portion extending from the front upwardly and arcuately rearwardly, the top portion having a terminal end forming a latch to secure the top portion to the back, the top portion further comprising a hanger for displaying the package, wherein each side is arcuately and upwardly tapered from the front to the back, and wherein the back has an upper end tapered inwardly from each of the two sides and the top portion terminal end is tapered near the location where the latch is secured to the body portion.

2. The package as claimed in claim 1 wherein the front, back and sides each have formed an extending lower tab foldable to cooperatively engage with each other and form the bottom.

3. The package as claimed in claim 1 wherein each side is inwardly tapered and having a foldable back joining edge to cooperatively join the side to the back in a flat surface-to-surface relationship near the location where the latch is secured to the body portion.

4. The package as claimed in claim 1 wherein the package is formed from a single piece of flexible material.

5. The package as claimed in claim 1 wherein the front, back and sides each have formed an extending lower tab foldable to cooperatively engage with each other and form the bottom, the sides are inwardly tapered to cooperatively join the back to the sides near the location where the latch is secured to the body portion, and the package is formed from a single piece of flexible material.

6. The package of claim 2, wherein the top portion hanger and terminal end latch are formed from a diecut tab.

7. A flexible one-piece package comprising:

a body portion having integrally connected front, back, bottom and sides; and a top portion integrally connected to and extending from the front upwardly and arcuately rearwardly to a terminal end formed with a latch to secure the top portion to the back, the top portion further comprising a hanger for displaying the package, wherein the back is a tapering upper end, wherein the top portion terminal end is tapered near the location where the latch is secured to the back, wherein the sides are arcuately and upwardly tapered from the front to the back, wherein the front, back and sides each have formed an extending lower tab foldable to cooperatively engage with each other and form the bottom, wherein each side has a back joining edge that is folded to cooperatively join the side to the back in a flat surface-to-surface relationship near the location where the latch is secured to the back, and wherein the top portion terminal end latch and hanger are formed from a diecut tab, the hanger having a hole therein adjacent the latch.

* * * * *